US007676180B2

(12) United States Patent
Watanabe

(10) Patent No.: US 7,676,180 B2
(45) Date of Patent: Mar. 9, 2010

(54) LIQUID DEVELOPMENT APPARATUS, LIQUID DEVELOPMENT METHOD AND IMAGE FORMING APPARATUS

(75) Inventor: Makiko Watanabe, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 869 days.

(21) Appl. No.: 11/444,824

(22) Filed: Jun. 1, 2006

(65) Prior Publication Data

US 2006/0291908 A1 Dec. 28, 2006

(30) Foreign Application Priority Data

Jun. 8, 2005 (JP) ..... 2005-168016
Mar. 31, 2006 (JP) ..... 2006-097495

(51) Int. Cl.
*G03G 15/10* (2006.01)

(52) U.S. Cl. ..... 399/238; 347/158

(58) Field of Classification Search ..... 399/307, 399/237–251

See application file for complete search history.

(56) References Cited

U.S. PATENT DOCUMENTS 5,561,264 A * 10/1996 Iino et al. ..... 399/240
6,405,008 B1 6/2002 Obu et al.
6,501,932 B2 12/2002 Obu et al.
2002/0154923 A1* 10/2002 Baker et al. ..... 399/237

FOREIGN PATENT DOCUMENTS

JP 09-258520 10/1997
JP 2001-194913 7/2001

* cited by examiner

*Primary Examiner*—David M Gray
*Assistant Examiner*—Ruth N Labombard
(74) *Attorney, Agent, or Firm*—Brinks Hofer Gilson & Lione

(57) ABSTRACT

An objective of the present invention is to provide a liquid development apparatus that can form a uniformly thin layer of high-density liquid developer on the development roller, thereby forming images free of uneven density or toner fog, and another objective is to provide an inexpensive and compact liquid development apparatus which increases the flexibility in the arrangement. A liquid development apparatus in which a liquid developer supply head having a liquid developer discharge outlet for applying a liquid developer on the surface of the development roller is equipped with a section for reducing the viscosity of the liquid developer.

13 Claims, 5 Drawing Sheets

LIQUID DEVELOPMENT APPARATUS, LIQUID DEVELOPMENT METHOD AND IMAGE FORMING APPARATUS

This application is based on Japanese Patent Application No. 2005-168016 filed on Jun. 8, 2005, and No. 2006-97495 filed on Mar. 31, 2006, in Japanese Patent Office, the entire content of which is hereby incorporated by reference.

TECHNICAL FIELD

The present invention relates to a liquid development apparatus that uses a liquid developer to form a toner image when forming electrophotographic images, and relates to a liquid development method; and it also relates to an image forming apparatus that uses the liquid development apparatus.

BACKGROUND

Conventionally, printing presses have been used as a means to quickly produce massive amounts of printed materials. However, in the printing industry, there are a significantly large number of orders for small printing jobs which are unprofitable if the printing plate is made. Therefore, so-called on-demand printing, which is a print making technique suitable for executing such a small amount of printing, has been required.

As an image forming technique which is capable of quickly and inexpensively making a small number of printed materials, an electrophotographic image forming technique is attracting attention. The electrophotography includes two types of methods: a dry-process image forming method and a wet-process image forming method. The wet-process image forming method can produce toner images of excellent quality.

The wet-process image forming method uses a liquid developer in which toner is dispersed into an insulating liquid; and from perspectives of the fast image forming process and the compact developing equipment, high-density liquid developers are used which contain a high concentration of toner. However, the use of a high-density liquid developer tends to create uneven thickness of the film when a thin layer of liquid developer is formed on the development roller. As a result, there is a problem in that uneven density occurs on the image. Also, toner gets on the non-image portion on the image carrier, causing toner fog on the white background, which has been a problem.

Accordingly, a technique has been studied which uses a high-density liquid developer to form a thin layer on the development roller. Specifically, a method (for example, see patent document 1) has been proposed in which a stirring member incorporated into the liquid developer storage tank stirs the developer in the storage tank of the development apparatus, thereby decreasing the developer's viscosity, and then the low-viscosity liquid developer is applied onto the development roller.

Furthermore, a liquid development apparatus (for example, see patent document 2) has been proposed which is equipped with a slit-type discharge outlet positioned along the direction of the development roller's axis so that the supply rate of liquid developer in the axial direction of the development roller is constant, and the apparatus is also equipped with a liquid developer supply head that has fewer components than the conventional apparatus, which makes the apparatus inexpensive and compact.

[Patent document 1] Japanese Laid-Open Patent Application No. 2001-194913

[Patent document 2] Japanese Laid-Open Patent Application No. H9-258520

However, a liquid development apparatus disclosed in patent document 1 has more components than the conventional apparatus due to a stirring device for stirring the liquid developer contained in the liquid developer storage tank. Furthermore, a large, high-torque drive motor is used for the stirring operation. Consequently, costs and the size of the development apparatus have been increased, which makes it impossible to provide a compact image forming apparatus.

On the other hand, if a high-density liquid developer is used in a liquid development apparatus disclosed in patent document 2, air is mixed into the liquid developer between the liquid developer supply head's discharge outlet and the development roller due to the developer's high viscosity, causing the discharge rate of the liquid developer from the discharge outlet to intermittently increase and decrease, thereby making it impossible to steadily apply the developer onto the development roller. As a result, it is impossible to form a uniformly thin layer of the liquid developer on the development roller, thereby failing to eliminate the occurrences of uneven density and toner fog.

An object of the present invention is to provide a liquid development apparatus, a liquid development method and an image forming apparatus which are capable of forming a uniformly thin layer of liquid developer on the development roller while using a highly viscous liquid developer which contains a highly dense toner.

In view of forgoing, one embodiment according to one aspect of the present invention is a liquid development apparatus, comprising:

an image carrier on which an electric latent image is formed;

a development roller which is arranged in an opposing position to the image carrier and develops the electric latent image with a thin layer of liquid developer, provided on a surface of the development roller, containing toner and charier liquid;

a storage tank which stores the liquid developer;

a liquid developer supply head which includes a discharge outlet which is provided in a direction of an axis of the development roller and discharges the liquid developer from the storage tank on the surface of the development roller; and a viscosity reducing member which is provided in a vicinity of the discharge outlet.

According to another aspect of the present invention, another embodiment is a liquid development method, comprising the steps of:

reducing a viscosity of liquid developer in a liquid developer supply head which includes a discharge outlet which is provided in a direction of an axis of a development roller and discharges the liquid developer from the storage tank on the surface of the development roller;

forming a thin layer of the liquid developer by discharging the liquid developer from the discharge outlet; and developing an electric latent image formed on a image carrier with the thin layer of the liquid developer;

wherein a member which reduces a viscosity of the liquid developer and is provided in a vicinity of the discharge outlet.

According to another aspect of the present invention, another embodiment is an image forming apparatus, comprising;

a storage tank which stores liquid developer containing toner and carrier liquid;

a liquid developer supply head which includes a discharge outlet for discharging the liquid developer from the storage tank; a development roller which carries a thin layer of the liquid developer discharged from the discharge outlet;

an image carrier on which an electric latent image is formed; and a member which reduces a viscosity of the liquid developer and is provided in a vicinity of the discharge outlet of the liquid developer supply head;

wherein the electric latent image is developed by transferring the thin layer of the liquid developer to the electric latent image by the development roller.

BRIEF DESCRIPTION OF THE DRAWINGS

FIG. 2(*b*) is a schematic diagram of a liquid developer supply head that has a slit-type discharge outlet, which is viewed from the discharge outlet side, incorporated in a liquid development apparatus according to an embodiment of the present invention.

FIG. 2(*c*) is a schematic diagram of a liquid developer supply head having plural nozzle-type discharge outlets, which is viewed from the discharge outlet side, incorporated in a liquid development apparatus according to an embodiment of the present invention.

DETAILED DESCRIPTION OF THE PREFERRED EMBODIMENT

The present inventor concentrated on the liquid developer which moves from the storage tank towards the discharge outlet by means of a pumping action in the head to supply the liquid developer to the development roller.

The inventor thought that if a shear force is applied to a moving liquid developer, it may be possible to reduce the viscosity of the developer to a desired degree without applying a large force. That is, the inventor thought that if a portion of the path, along which a liquid developer moves, inside the head is made narrow, a shear force is applied when the liquid developer passes through it, thereby reducing the viscosity of the developer. And, after doing some research, the inventor provided a device on the path along which the developer moves and found out that, when the developer passes through the device, a uniformly thin layer can be formed on the development roller.

Thus, the present invention was made based on the idea that a shear force is applied to a liquid developer which is moving inside the head for supplying the liquid developer to the development roller and it was actually found out that a shear force can be applied to the developer on the supply path located in the head.

Hereafter, an embodiment of the present invention will be described with reference to the drawings.

Figure 1:
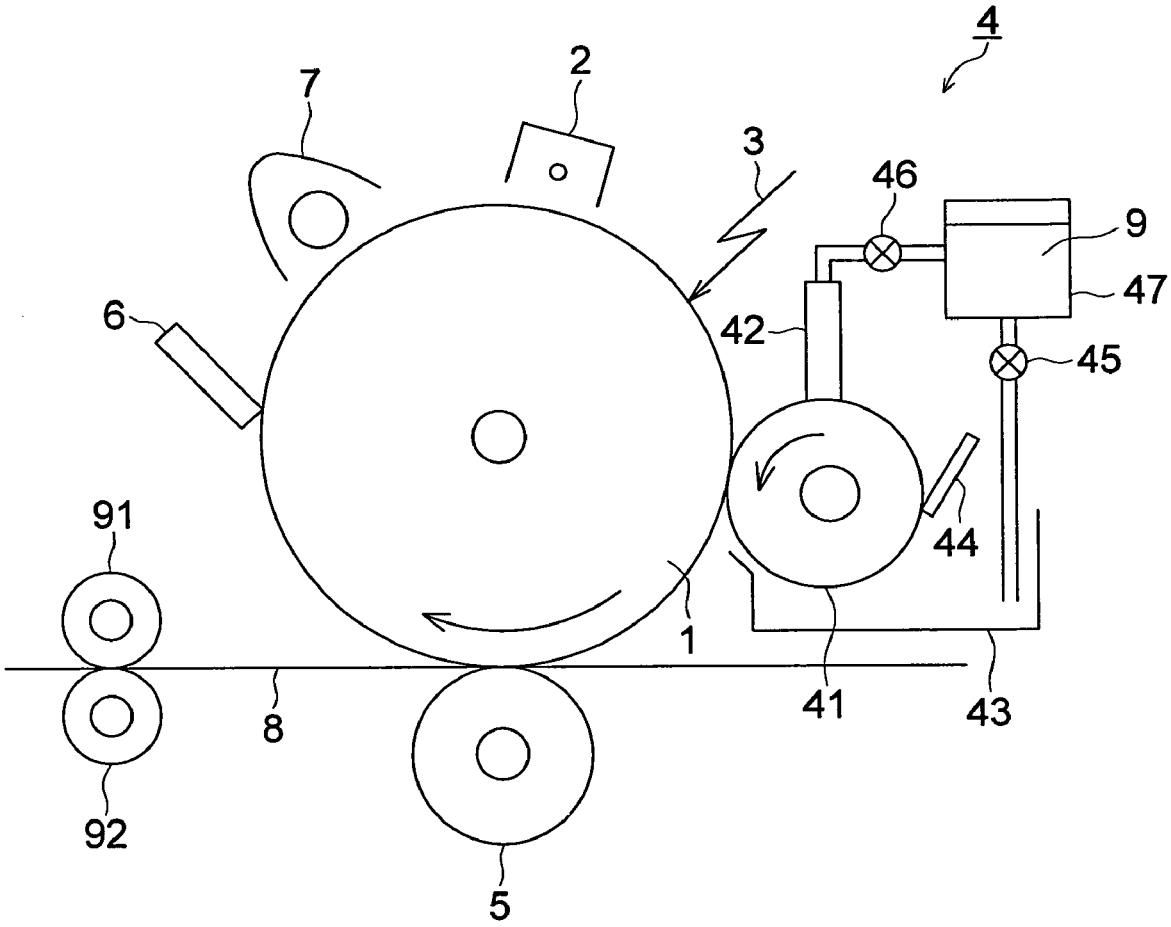
FIG. 1 is a schematic diagram of an image forming apparatus equipped with a liquid development apparatus according to an embodiment of the present invention.

FIG. 1 is a schematic diagram of an image forming apparatus equipped with a liquid development apparatus according to a preferred embodiment of the present invention. On the circumference of the drum-type image carrier 1 and in sequential order along the direction of rotation as shown by the arrow, there are provided an electrification apparatus 2, an exposure device 3, a liquid development apparatus 4, a transfer roller 5, a cleaning blade 6, and a neutralization lamp 7. The surface of the image carrier 1 is uniformly electrified by the electrification apparatus 2 so that the surface potential can attain a specific level, and then, the exposure device 3 exposes image data, thereby forming an electrostatic latent image on the surface of the image carrier 1. Next, the electrostatic latent image formed on the image carrier 1 is developed by the liquid development apparatus 4 which contains a liquid developer 9, thereby forming a toner image on the image carrier 1.

The toner image formed on the image carrier 1 is transferred onto the transfer paper 8 by a transfer roller 5 to which a certain amount of voltage has been applied. After that, the toner image is firmly fixed on the transfer paper 8 by passing through fixing rollers 91 and 92 which have been kept at a certain temperature. Furthermore, the liquid developer 9, which remains on the image carrier 1 after the toner image has been transferred, is removed by a cleaning blade 6. This process is repeated to continuously form images on the transfer paper 8.

The liquid development apparatus 4 has a development roller 41 and a liquid developer supply head 42. A given quantity (referred to as Q) of liquid developer 9 stored in the storage tank 47 is supplied to the liquid developer supply head 42 by means of a pump 46.

Main ingredients of the liquid developer 9 are an insulating liquid which is a carrier liquid, an electrified toner which processes an electrostatic latent image and a dispersing agent which disperses the toner.

Any carrier liquid can be used as far as it is formulated such that it can be used as a general electrophotographic liquid developer. For example, chain or branched-chain aliphatic hydrocarbon and aromatic hydrocarbon are available. Specifically, n-pentane, cyclohexane, isoparaffin, chlorinated paraffin, naphtha, and kerosene oil can be used. More specifically, MORESCO WHITE made by Matsumura Oil Research Corporation can be used.

Any toner can be used as far as it is formulated such that it can be used as a general electrophotographic liquid developer. A toner consists of a coloring agent and a binding resin which functions as a binder. As a binding resin, for example, thermoplastic resins, such as a polystyrene resin, styrene-acrylic resin, acrylic resin, polyester resin, epoxy resin, polyamide resin, polyimide resin, and polyurethane, resin, can be used. A mixture of two or more resins can be used. Furthermore, pigments and dyes used as coloring agents are sold in markets. For example, as a pigment, carbon black, colcothar, titanium oxide, silica, phthalocyanine blue, phthalocyanine green, sky blue, benzidine yellow, and lake red D can be used. As a dye, solvent red 27 and acid blue 9 can be used.

A liquid developer can be dispensed by a general dispensing method. For example, a binding resin and a pigment are mixed at a given compounding ratio and the mixture is melted, kneaded and uniformly dispersed by using a pressurizing kneader and a rolling mill, and then the substance is finely ground by a jet mill. The fine powder which is obtained is then sorted by a wind-force classifier, thereby obtaining a toner of desired particle diameter.

Subsequently, the obtained toner is mixed with an insulating liquid that functions as a carrier liquid at a given compounding ratio. This mixture is uniformly dispersed by a dispersing device such as a ball mill, thereby a liquid developer is obtained.

Preferably, the toner density of a liquid developer to be used in the liquid development apparatus according to the present invention should be high, such as 10 to 50 percent by mass or preferably 20 to 40 percent by mass, in order to create a compact liquid development apparatus that can process at a high speed.

Although the viscosity of a liquid developer mainly depends on the toner density, the average viscosity measured at 25° C. for 60 seconds at a shear rate of 0.1 per second should be 1 Pa·s or more and 100 Pa·s or less; preferably 5 Pa·s or more and 40 Pa·s or less. In order to make the viscosity of the developer, in which the toner density is 10 percent by mass or more, 1 Pa·s or less, a large number of additives are required to increase the dispersibility of the toner. Most additives not only change the toner's electrification characteristics, but also have an adverse effect on humans and the environment; therefore, it is desirable to minimize the use of additives. Accordingly, to reduce the quantity of additives that increase dispersibility, the viscosity of a liquid developer should preferably be 5 Pa·s or more.

Furthermore, if the viscosity exceeds 100 Pa·s, another problem arises in that a large amount of energy is required to transport the developer that is being held in the storage tank. If the viscosity is 40 Pa·s or less, less energy is needed to move the developer, thereby reducing the shear force and working time.

Moreover, the viscosity of the liquid developer is an average value when it is measured for 60 seconds at a shear rate of 0.1 per second by using TA INSTRUMENTS' viscometer (part number: AresFR-100) after the developer has been stationarily stored for 24 hours. In a conventional technique, if such a highly viscous liquid developer is used, there is a problem in that the amount of liquid developer that flows from the liquid developer supply head tends to be nonuniform along the direction of the development roller's axis. However, in the present invention, the liquid developer supply head is equipped with a device which applies a shear force to the liquid developer, thereby making it possible to decrease the viscosity of such highly dense and highly viscous liquid developer. As a result, the liquid developer can uniformly flow along the direction of the development roller's axis, thereby making it possible to form a uniformly thin layer of liquid developer on the development roller.

Thus, in the present invention, a highly viscous liquid developer, which has the viscosity of 1 Pa·s or more and 100 Pa·s or less, can be used for forming images without requiring a special stirring device or a large motor. As a result, it is possible to decrease the size and costs of the development apparatus as well as increasing the flexibility in the arrangement of the liquid development apparatus in the image forming apparatus. Furthermore, no special stirring device is required to dispense a liquid developer that has the viscosity of the above-mentioned range, which is advantageous because the liquid developer production costs are not increased.

The viscosity of the liquid developer can be measured by TA INSTRUMENTS' viscometer Ares (part number: FR-100).

The viscosity of the liquid developer is adjusted as stated above, and a device that applies a shear force to the liquid developer is positioned in a liquid developer supply head according to the present invention, thereby making it easy to form a uniformly thin layer of liquid developer on the development roller. Furthermore, since the toner density can be high, it is possible to reduce the total amount of liquid developer to be used when compared with the use of a conventional liquid developer with low viscosity (for example, less than 1 Pa·s). Consequently, it is possible to make the liquid development apparatus compact.

Next, with reference to FIG. 2(*a*), FIG. 2(*b*) and FIG. 2(*c*), a liquid developer supply head 42 will be described.

Figure 2:
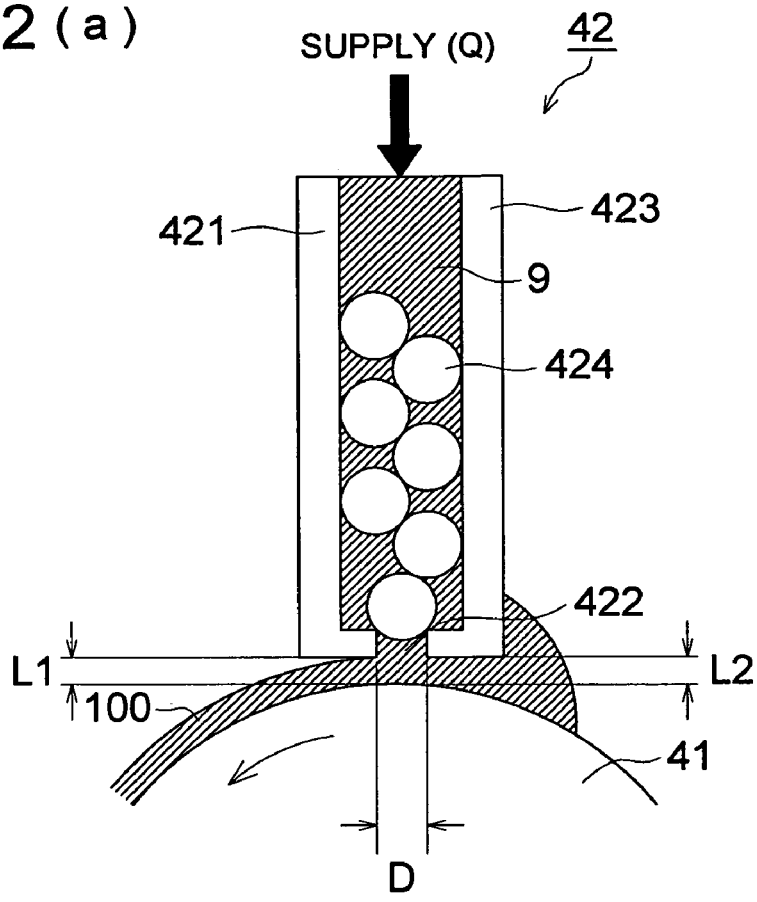
FIG. 2(*a*) is a schematic diagram of a liquid developer supply head incorporated in a liquid development apparatus according to an embodiment of the present invention.
Figure 2:
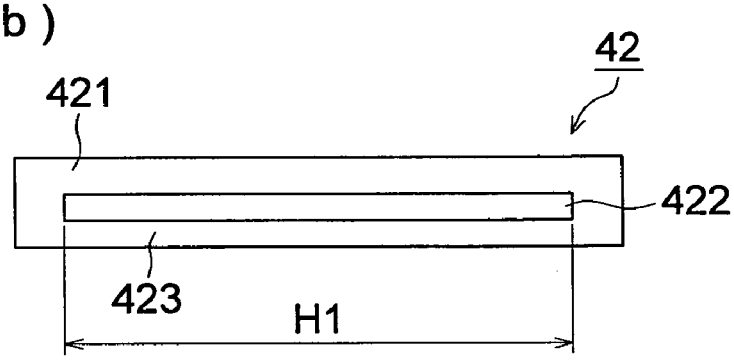
Figure 2:
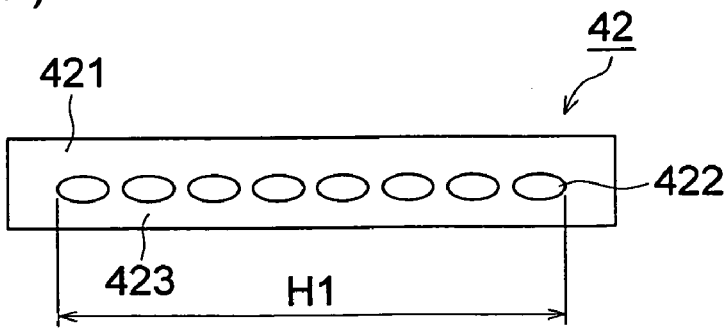

FIG. 2(*a*), FIG. 2(*b*) and FIG. 2(*c*) are schematic diagrams of a first embodiment of a liquid developer supply head incorporated in the liquid development apparatus according to the present invention.

FIG. 2(*a*) is a schematic diagram of the section of the liquid developer supply head 42. FIG. 2(*b*) is a schematic diagram of a liquid developer supply head 42, viewed from the discharge outlet side, which has a slit-type discharge outlet 422 from which a liquid developer 9 is discharged. The discharge outlet of the liquid developer supply head located in the liquid development apparatus according to the present invention can be a slit or consist of plural nozzle-type holes. FIG. 2(*c*) shows the discharge outlet which consists of plural nozzle-type holes. Either type of discharge outlet 422 is available; however, the discharge outlet with a plurality of nozzle-type holes is more preferable because the liquid developer supply head 42 is rigid and the dimension accuracy is high.

Preferably, the width of the discharge outlet 422 in the longitudinal direction should be shorter than the width of the image carrier 1 surface which is uniformly electrified and longer than the width of the image carrier 1 surface on which an image is exposed to form a latent image or the width of the area that can be developed by a development roller. Such a setting makes it possible to prevent the effects (non-uniform cleaning of the image carrier 1 and non-uniform transfer at the transfer section, etc.) of an uneven thin layer of liquid developer formed on the development roller 41 which occurs on both sides of the liquid developer supply head 42 in the longitudinal direction.

A pump 46 (see FIG. 1) pumps a given quantity (Q) of liquid developer 9 to the liquid developer supply head 42. The supplied liquid developer 9 passes through the clearance among microspheres 424 incorporated in the liquid developer supply head 42 and is discharged from the discharge outlet 422. At that time, the viscosity of highly viscous liquid developer 9 is reduced because when the developer passes through the clearance among microspheres 424 by means of the pressure of the pump 46, a mechanical shear force is applied to the developer. The phenomenon in which viscosity is reduced as the shear force increases is a commonly known phenomenon. Thus, the low-viscosity liquid developer 9 that has passed through the discharge outlet 422 is controlled by minimum distance L1 between the side plate 421 and the development roller 41 so that the uniformly thin layer of liquid developer with a given thickness can be formed. At that time, uneven thickness of liquid developer, which conventionally occurs when a highly viscous liquid developer is used, does not occur, and a uniformly thin layer can be obtained.

The set value of minimum distance L1 between the liquid developer supply head 42 and the development roller 41 can be between approximately 0.1 μm and 10,000 μm, but between 2 μm and 1,000 μm is more preferable. Furthermore, the value of minimum distance L1 should be larger than the diameter of the toner particle so that a toner in the liquid developer can smoothly pass through the clearance. Furthermore, if the set value of minimum distance L1 is too large, the thickness of the thin layer of liquid developer formed on the development roller 41 increases, which results in a longer time for the toner to flow during the development process, causing a problem in that the development process is slowed down.

The diameter of microsphere 424 incorporated in the liquid developer supply head 42 can be between 30 μm and 3,000 μm, but between 50 μm and 1,000 μm is more preferable. Furthermore, it is allowable if width D of the discharge outlet 422 is smaller than the diameter of the microsphere 424 so that the microsphere 424 does not come out of the discharge outlet. By setting the diameter of the microsphere 424 within the range mentioned above, it is possible to sufficiently decrease the viscosity of the liquid developer 9 thereby discharging the developer in a stable manner without requiring a high-pressure pump to discharge the developer.

In this embodiment, an excess liquid developer which is controlled by the side plate 421 is allowed to overflow from the area between the upstream-side side plate 423 and the development roller 41. Alternatively, an outlet (not shown) can be provided on both ends of the side plate 421 in the axial direction of the development roller 41 to allow the excess liquid developer to overflow; and the excess developer can then be recovered in a receiver 43 (see FIG. 1) or in a different excess liquid receiver (not shown) and pumped back to the storage tank 47 (see FIG. 1).

Furthermore, in the present invention, it was verified that the thin layer can steadily be formed when the relationship, described below, is established among the liquid developer supply rate Q, the circumferential velocity V of the development roller 41 and the length H1 of the discharge outlet 422 in the axial direction of the development roller.

Preferably, the relationship should be $0.5 \leqq L1 \cdot V \cdot H1/Q \leqq 1.0$, but $0.8 \leqq L1 \cdot V \cdot H1/Q \leqq 0.98$ is more preferable.

When the above range is satisfied, it was verified that a liquid developer is sufficiently supplied, and the uniformly thin layer can be formed on the development roller. Specifically, when a highly viscous developer, which has an average viscosity that exceeds 40 Pa·s when measured at a shear rate of 0.1 per second for 60 seconds, is used, the surface of the developer tends to be uneven when the developer is applied on the development roller 41 because its fluidity decreases more quickly than that of a low-viscosity developer after it has been relieved from a shear force. Accordingly, by establishing the relationship-expressed by $L1 \cdot V \cdot H1/Q \leqq 0.98$, the supply head 42 can control the supply rate of the developer, thereby uniformly forming the thin layer Furthermore, the excess developer controlled by the supply head 42 remains on the upstream side of the head. If too much highly viscous developer remains, its fluidity decreases before it is recovered, and the developer is not completely removed creating a pool, which causes flaws on the image such as a stain in the background of an image. It was verified that this problem is solved when $0.8 \leqq L1 \cdot V \cdot H1/Q$ is established.

The mechanism described above makes it possible to form a thin layer 100 of liquid developer, which includes a high-density toner, on the surface of the development roller 41. It is possible to form an image which is free of toner fog or uneven density by developing an electrostatic latent image on the image carrier 1 by using the thin layer 100 of liquid developer.

Furthermore, although microspheres 424 are used in this embodiment, some small objects, other than the sphere, can be used that can create narrow clearances through which a liquid developer 9 pumped from a pump 46 can pass when the objects are incorporated in the liquid developer supply head 42; and aspheric objects with uneven surface can also be used.

Thus, by incorporating a member for applying a mechanical shear force to a liquid developer to decrease its viscosity as it flows into a liquid developer supply head, a conventional thin-layer forming mechanism consisting of plural rollers is not required. Consequently, it is possible to provide an inexpensive and compact liquid development apparatus with the flexibility in the arrangement.

After the development process has been finished, the excess thin layer 100 of liquid developer that remains on the development roller 41 is removed from the surface of the development roller by a cleaning blade 44. The thin layer 100 of liquid developer that has been removed is stored in a developer receiver 43 (see FIG. 1).

The liquid developer 9 that has been stored in the developer receiver 43 (see FIG. 1) is returned to the storage tank 47 by the pump 45, and then the density of the liquid developer 9 stored in the storage tank 47 is adjusted by supplying a high-density liquid from a high-density liquid tank, not shown.

The liquid developer supply head 42 can be produced by means of the molding of resin materials (extrusion molding method, die-cut molding method, etc.), mechanical machining or laser-beam machining. It can also be created by pasting plate materials to each other.

Various materials can be used for the liquid developer supply head 42. Recommended resin materials are acrylic resin, polycarbonate resin, and polyester resin.

Furthermore, various materials can be used for the microsphere 424.

Figure 3:
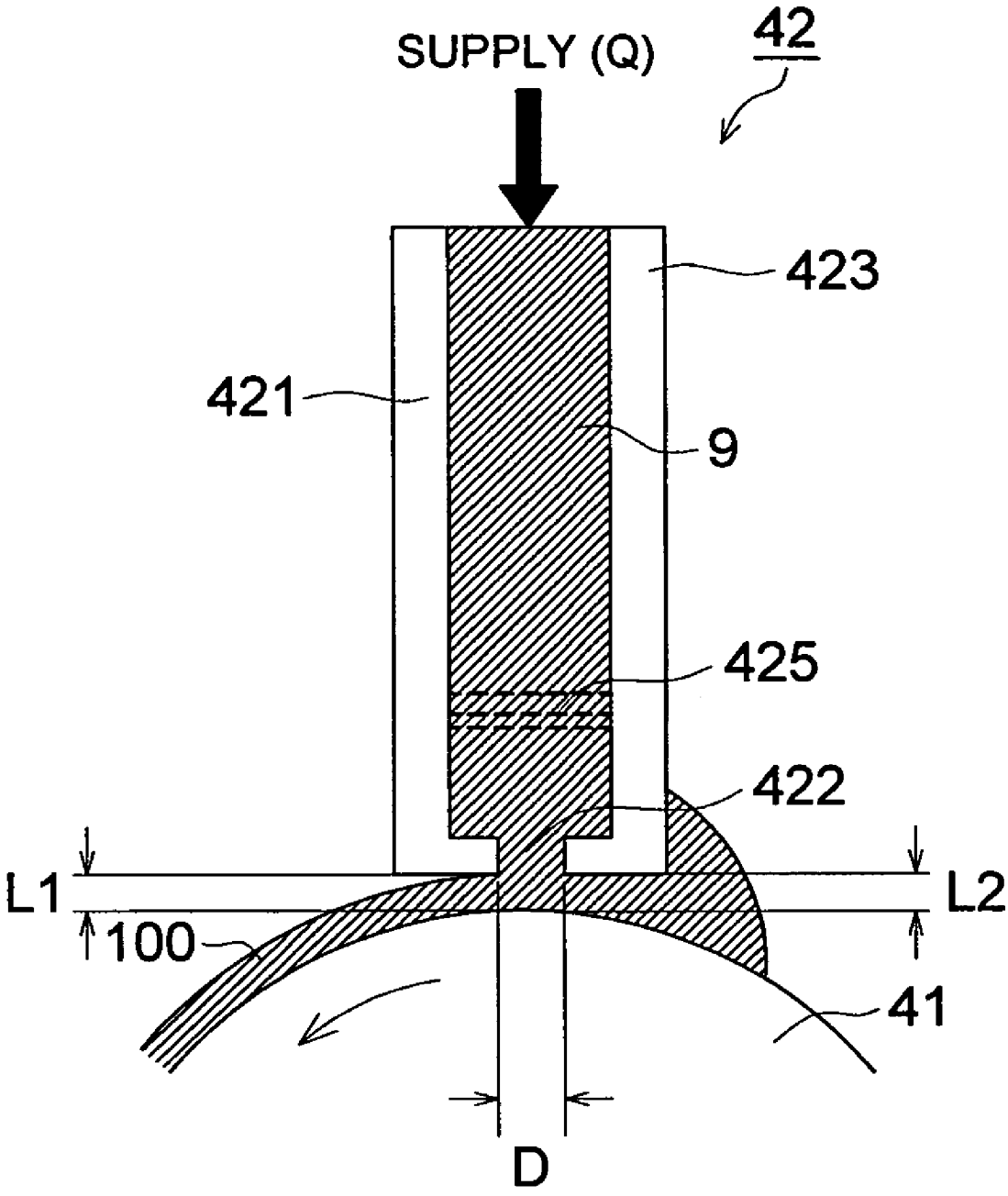
FIG. 3 is a schematic diagram of a liquid developer supply head incorporated in a liquid development apparatus according to an embodiment of the present invention.

FIG. 3 is a schematic diagram of a second embodiment of a liquid developer supply head incorporated in the liquid development apparatus according to the present invention. In this embodiment, a wirelike member is used which is the equivalent to a microsphere 424 used in the first embodiment. Specifically, a mesh member 425 is used as a wirelike member. The mesh member 425 applies a mechanical shear force to the liquid developer 9 that is supplied to the liquid developer supply head 42. Although three mesh members 425 are used in this embodiment, the number of meshes to be used is not restricted. When a developer passes through fine apertures of the mesh member 425 by means of the pump's 46 pressure, a shear force is applied to the liquid developer 9, thereby reducing the viscosity of the high-density liquid developer 9. This decreased-viscosity liquid developer 9 is discharged from the discharge outlet 422 onto the development roller 41, and the uniformly thin layer 100 of liquid developer is formed as in the same manner as the first embodiment.

Various materials can be used for the mesh member 425. The opening (interval between wires that consist of a mesh) of the mesh member 425 should be between 30 μm and 3,000 μm, but between 50 μm and 1,000 μm is more preferable. Furthermore, the mesh (the unit that represents the number of openings per inch <2.54 cm>) of the mesh member 425 should preferably be between 5 meshes and 500 meshes. By setting the opening of the mesh member 425 at between 30 μm and 3,000 μm, it is possible to sufficiently reduce the viscosity of liquid developer 9 and also steadily discharge a liquid developer without increasing the pressure of the pump.

The mesh member 425 can be made by knitting metal wires into a net or etching a metal plate to form a member that contains a multitude of apertures.

Although a mesh member 425 is used as a wirelike member, it is possible to lay wirelike members side by side at constant intervals. It is allowable if a shear-force is applied to the liquid developer 9 as it passes through the wirelike members, thereby reducing the viscosity of the liquid developer.

As stated above, by incorporating a wirelike member into a liquid developer supply head 42, it is possible to reduce the viscosity of the high-density liquid developer 9 which is supplied by a pump 46. Accordingly, a thin-layer forming mechanism consisting of plural rollers as shown in the conventional technique is not required. Consequently, it is possible to provide an inexpensive and compact liquid development apparatus with the flexibility in the arrangement.

Figure 4:
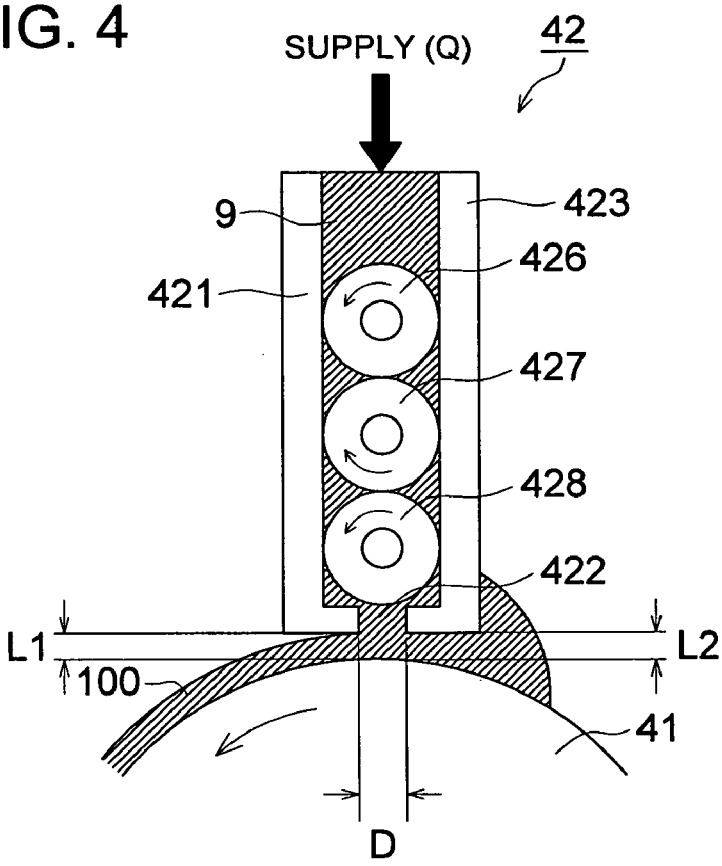
FIG. 4 is a schematic diagram of a liquid developer supply head incorporated in a liquid development apparatus according to an embodiment of the present invention.

Furthermore, FIG. 4 is a schematic diagram of a third embodiment of a liquid developer supply head 42 incorporated into a liquid development apparatus according to the present invention. This embodiment incorporates a rotating body, which applies a'shear force to a liquid developer 9, into a liquid developer supply head 42. Specifically, roller members 426, 427 and 428 are used as rotating bodies. These roller members 426, 427 and 428 rotate and drive in the direction indicated by the arrow in the drawing, but the direction of drive is not specifically limited. These roller members 426, 427 and 428 apply a shear force to a liquid developer 9 when the liquid developer 9 supplied from the pump 46 passes through the inside of the liquid developer supply head. Consequently, the viscosity of the liquid developer 9 decreases. This decreased-viscosity liquid developer 9 is discharged from the discharge outlet 422 to the development roller 41, and the uniformly thin layer 100 of liquid developer is formed in the same manner as shown in the first embodiment.

Material of roller members 426, 427 and 428 is not specifically limited, and the material can be metal or resin. The surface of the roller members 426, 427 and 428 should preferably be roughened by means of blasting. The average surface roughness (Rz) should preferably be 0.5 μm or greater according to an average roughness of ten points. If it is less than 0.5, a sufficient shear force is not applied to a liquid developer 9, which fails to reduce the viscosity of the developer.

Figure 5:
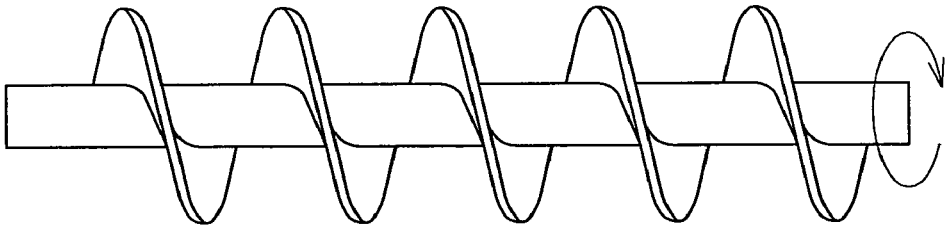
FIG. 5 is a schematic diagram of a spiral rotating member located in a liquid developer supply head incorporated in a liquid development apparatus according to an embodiment of the present invention.
Figure 6:
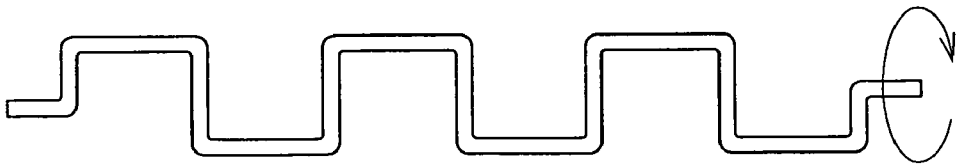
FIG. 6 is a schematic diagram of a wirelike rotating member located in a liquid developer supply head incorporated in a liquid development apparatus according to an embodiment of the present invention.

As an alternative to the roller members 426, 427 and 428, a spiral rotating member 429 shown in FIG. 5 or a wirelike member shown in FIG. 6 can be used as a rotating body that applies a shear force to a liquid developer 9 in the liquid developer supply head 42.

When a rotating body applies a shear force to a liquid developer 9 in the liquid developer supply head 42 to reduce the viscosity of the developer, as is the case for this embodiment, it takes time for the stirring operation. Therefore, if the rotating body is driven simultaneously with the image forming operation so as to process an electrostatic latent image formed on the image carrier 1 by means of the development roller 41, a highly viscous liquid developer 9 is discharged from the discharge outlet 422, causing uneven thickness in the axial direction of the development roller when the thin layer 100 of liquid developer is formed between the downstream-side side plate 421 and the development roller 41. The reason for this is: when the viscosity of the liquid developer 9 is high, a portion of the thin layer 100 of liquid developer is separated from the downstream-side side plate 421 in the vicinity of the minimum distance (portion of L1) between the downstream-side side plate 421 and the development roller 41, and the other portion of the thin layer 100 of liquid developer is separated from the downstream-side side plate 421 at a location further downstream of the minimum portion. Those two areas end up with uneven thickness of the thin layer 100 of liquid developer because those areas are uneven in the axial direction of the development roller. If an electrostatic latent image on the image carrier 1 is processed by the development roller 4 in this procedure, uneven density of image occurs or toner fog occurs on the white background of an image.

An image forming apparatus according to this embodiment is equipped with a detection device for detecting a driving torque of the above-mentioned rotating body, and processes an electrostatic latent image formed on the image carrier 1 after the value detected by the detection device has reached a given value.

Specifically, when printing starts from the stand-by mode, the rotating body is first rotated, a torque is detected, and after the detected value has reached a given value, an image carrier 1, exposure device 3, development roller 4, transfer device 5, fixing devices 91 and 92, and a pump 46 are activated. That is, by processing an electrostatic latent image formed on the image carrier 1 by means of the rotation of the development roller 4 after a rotating torque of the rotating body has reached a given value, the viscosity of the thin layer 100 of liquid developer is reduced, and then the development process starts in the condition in which the thickness of the thin layer is uniform. By doing so, it is possible to form an image free of uneven image density or toner fog on the image's white background.

Figure 7:
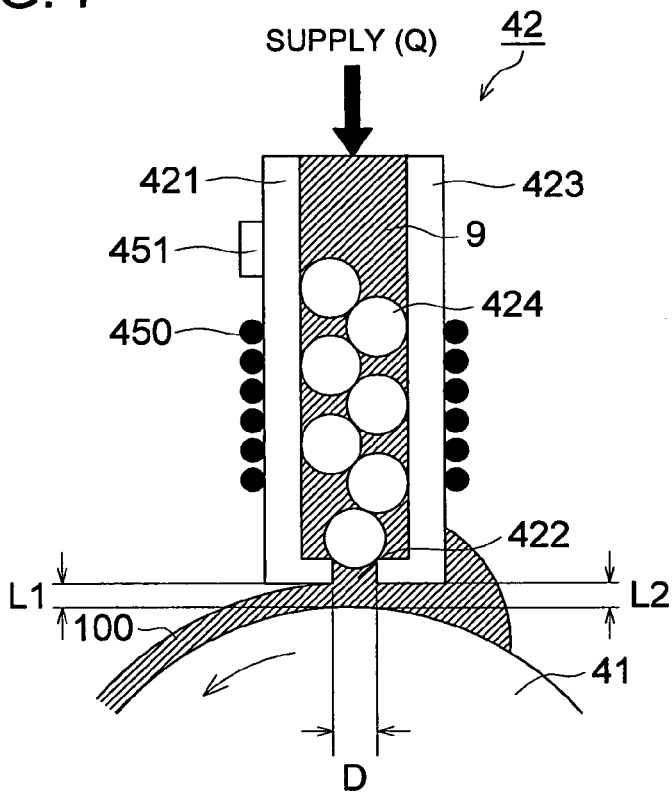
FIG. 7 is a schematic diagram of a liquid developer supply head incorporated in a liquid development apparatus according to an embodiment of the present invention.

Furthermore, FIG. 7 is a schematic diagram of a fourth embodiment of a liquid developer supply head 42 incorporated in a liquid development apparatus according to the present invention. In addition to a device which applies a shear force to a liquid developer in the liquid developer supply head 42, this embodiment is equipped with a heat source which heats up a liquid developer 9 to help decrease the viscosity of the liquid developer 9. Specifically, a heater 450 is incorporated, and the heater 450 is controlled by a controller, not shown, based on the detection signal from a temperature sensor 451. In FIG. 7, the heater 450 and the temperature sensor 451 are positioned outside the liquid developer supply head 42, but they can be positioned inside. The temperature must be below the toner's melting point so that the toner contained in the liquid developer 9 does not deteriorate, nor should it be at a temperature which would evaporate the carrier liquid. Thus, by heating up a liquid developer 9 contained in the liquid developer supply head 42 by means of a heat source and simultaneously using a device for applying a shear force to the liquid developer 9, it is possible to obtain a low-viscosity liquid developer 9. As a result, it is possible to form an excellent image free of uneven image density or toner fog on the white background.

In this embodiment, a sphere is used as a device for applying a shear force to a liquid developer 9 contained in the liquid developer supply head 42, but a wirelike member or rotating body can also be used.

Figure 8:
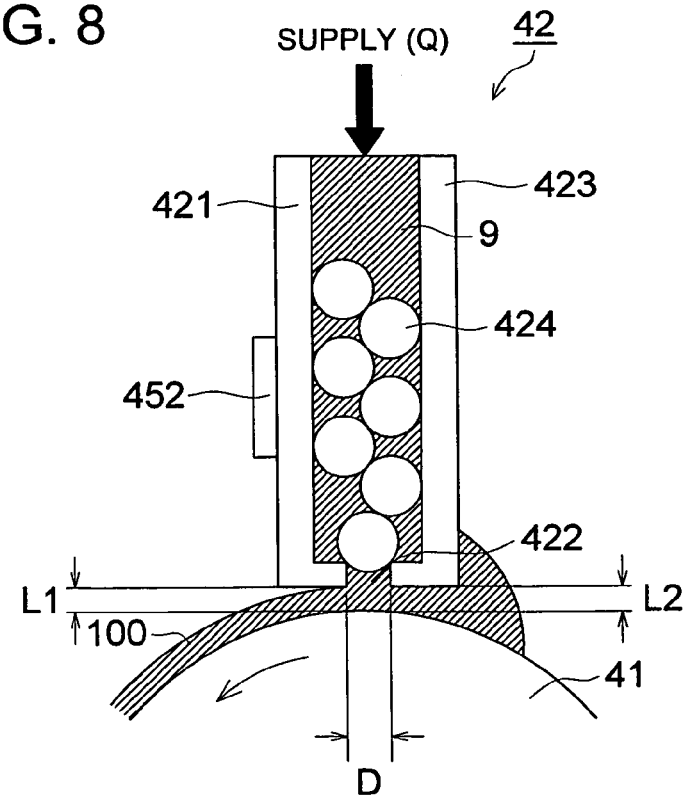
FIG. 8 is a schematic diagram of a liquid developer supply head incorporated in a liquid development apparatus according to an embodiment of the present invention.

Furthermore, FIG. 8 is a schematic diagram of a fifth embodiment of a liquid developer supply head 42 incorporated in the liquid development apparatus according to the present invention. In addition to a sphere 424 which functions as a device for applying a shear force to a liquid developer 9 contained in the liquid developer supply head 42, this embodiment is equipped with a ultrasonic transducer 52 which applies ultrasonic vibration to the liquid developer 9 to help decrease the viscosity of the liquid developer 9. This ultrasonic transducer 452 is controlled by an ultrasonic transmitter, not shown. In FIG. 8, an ultrasonic transducer 452 is positioned outside the liquid developer supply head 42, but it can be positioned inside. By applying an ultrasonic wave to the liquid developer supply head 42 by means of an ultrasonic transducer 452, it is possible to increase the fluidity of the liquid developer 9 contained in the liquid developer supply head 42, thereby reducing the viscosity. By using the ultrasonic vibration 452 together with a sphere 424 which functions as a device for applying a shear force, it is possible to further reduce the viscosity of the liquid developer 9 contained in the liquid developer supply head 42. As a result, it is possible to form an excellent image free of uneven image density or toner fog on the white background. Either an electrostrictive element or a magnetostrictive element can be used as an ultrasonic transducer 452, however, it is preferable to use an ultrasonic transducer that uses a piezoelectric element or a piezoelectric actuator. Furthermore, the frequency should preferably be between 10 KHz and 200 KHz.

In this embodiment, a sphere is positioned as a device for applying a shear force to a liquid developer 9 contained in the liquid developer supply head 42, but a wirelike member or a rotating body can be used.

Embodiments

Hereafter, effects of the liquid development apparatus according to the present invention will be explained specifically by showing embodiments. However, the present invention is not intended to be limited to the embodiments described below.

(1) Image Forming Apparatus

An image forming apparatus shown in FIG. 1 was used. An image carrier 1 is made by forming an organic photoreceptive film on an 80 mm diameter aluminum drum, and the circumferential velocity of the carrier 1 was set at 200 mm per second. The electrification apparatus 2 has a scorotron charger so that the surface potential of the image carrier 1 is −700 V. The setting for the exposure device 3 was made so that the surface potential of the image carrier 1 is −100 V when an image is exposed by a semiconductor laser.

Furthermore, conditions for the development roller 41 of the liquid development apparatus 4 are as follows:

Diameter: 40 mm

Material: NBR+Carbon black

Surface electric conductivity: $1.0\times10^{7}\Omega\cdot$cm

Rubber hardness: 50°

Circumferential velocity of development roller: 200 mm/sec

Bias voltage: −400 V

A slit-type liquid developer supply head 42, shown in FIG. 2(*b*), was used, and minimum distances L1 and L2, slit width D, slit length H1 are as follows:

L1: 10 μm

L2: 100 μm

D: 200 μm

H1: 300 mm (2) Production of the Liquid Developer

Liquid developers 1 through 5 with different viscosity were created by adding a toner (M72F made by Konica Minolta), having a particle diameter of 3 μm, to a carrier liquid (MORESCO WHITE P-120 made by Matsumura Oil Research Corporation). Herein, as shown in Table 1, liquid developers with different viscosity were created by adjusting the amount of toner to be added to the carrier liquid. Furthermore, with regard to liquid developers 1 and 2, a dispersing agent (SOLSUPERSE 13940 made by Avecia), which is 10 percent by mass of the toner, was added. Moreover, the amount of electrification of the toner of the obtained liquid developer, which was measured by an electrometer 6517 (Keithley), was approximately −200 μC per gram.

TABLE 1

| Developer No. | Toner density (Percent by mass) | Viscosity (Pa · s) (25° C., 0.1/s) |
|---|---|---|
| 1 | 10 | 1 |
| 2 | 15 | 5 |
| 3 | 20 | 40 |
| 4 | 30 | 70 |
| 5 | 35 | 100 |

(3) Liquid Developer Supply Head

Devices, described below, were incorporated into a liquid developer supply head 42, and combinations of the completed liquid developer supply head and liquid developers, shown in Table 1, were made and specified as embodiments 1 through 22 and comparative examples 1 through 4.

Specific combinations are shown in Table 2 below.

(a) Sphere (see FIG. 2(*a*))

Glass spheres of different diameter (800, 1,000, 2,000 and 3,000 μm) were used. Five grams of each kind of glass spheres were incorporated in a head and heads a1 through a4 were created.

(b) Mesh Member (See FIG. 3)

Heads b1 through b5 were made by using an etched SUS mesh member whose aperture is either 30, 50, 100, 1000, or 3000 μm.

(c) Roller Member (see FIG. 4)

Head c1 which incorporates three roller members of the following conditions was created.

Surface roughness (average roughness of ten points): 0.5 μm

Diameter: 6 mm

Material: SUS

Gap between rollers: 200 μm

Revolutions of roller: 150 rpm (d) Simultaneous Use of a Microsphere and an Ultrasonic Transducer (See FIG. 8)

Head d1 was created which incorporates 5 grams of 800-μm diameter glass spheres and is equipped with an ultrasonic transducer that uses a piezoelectric element. Conditions for the ultrasonic transducer are as follows:

Material: lead zirconate titanate

Shape: bolted Langevin type

Resonance frequency: 60 kHz (e) Head for Comparison

To compare different heads, heads e1 and e2 were made. Head e1 does not have spheres inside the above-mentioned head (a), and head e2 does not have glass spheres in the above-mentioned head (d).

TABLE 2

| Developer No. | Head No. | Head conditions | Supply rate (Q) ($10^{-6}$ $m^3$/sec) | L1 * V * H1/Q | Developer No. |
|---|---|---|---|---|---|
| Embodiment 1 | a1 | 800 μm | 1.2 | 0.50 | 1 |
| Embodiment 2 | a1 | 800 μm | 0.7 | 0.86 | 2 |
| Embodiment 3 | a1 | 800 μm | 0.7 | 0.86 | 3 |
| Embodiment 4 | a1 | 800 μm | 0.7 | 0.86 | 4 |
| Embodiment 5 | a1 | 800 μm | 1.2 | 0.50 | 4 |
| Embodiment 6 | a1 | 800 μm | 0.6 | 1.00 | 4 |
| Embodiment 7 | a1 | 800 μm | 0.6 | 1.00 | 5 |
| Embodiment 8 | a2 | 1000 μm | 0.7 | 0.86 | 3 |
| Embodiment 9 | a3 | 2000 μm | 0.7 | 0.86 | 3 |
| Embodiment 10 | a4 | 3000 μm | 1.2 | 0.50 | 4 |
| Embodiment 11 | b1 | 30 μm | 0.6 | 1.00 | 5 |
| Embodiment 12 | b2 | 50 μm | 0.6 | 1.00 | 5 |
| Embodiment 13 | b3 | 100 μm | 0.7 | 0.86 | 1 |
| Embodiment 14 | b3 | 100 μm | 0.7 | 0.86 | 2 |
| Embodiment 15 | b3 | 100 μm | 0.7 | 0.86 | 3 |
| Embodiment 16 | b3 | 100 μm | 1.2 | 0.50 | 4 |
| Embodiment 17 | b3 | 100 μm | 1.2 | 0.50 | 5 |
| Embodiment 18 | b4 | 1000 μm | 1.2 | 0.50 | 3 |
| Embodiment 19 | b5 | 3000 μm | 1.2 | 0.50 | 3 |
| Embodiment 20 | c1 | Roller | 0.6 | 1.00 | 3 |
| Embodiment 21 | c1 | Roller | 0.6 | 1.00 | 5 |
| Embodiment 22 | d1 | a1 + ultrasonic wave | 1.2 | 0.50 | 5 |
| Comparative example 1 | e1 | — | 0.7 | 0.86 | 1 |
| Comparative example 2 | e1 | — | 0.7 | 0.86 | 3 |
| Comparative example 3 | e2 | Ultrasonic wave | 0.7 | 0.86 | 1 |
| Comparative example 4 | e2 | Ultrasonic wave | 0.7 | 0.86 | 3 |

(4) Evaluation Experiment

Evaluations have been conducted for each image forming apparatus which combines one of liquid developers 1 through 5, shown in Table 2, and each head. For the evaluations, an A4-size original document which has four different images of the same size, such as a solid black image with the reflection density of 1.30, a halftone image with a pixel rate of 30%, a white background image, and a fine-line image with 10 lines per millimeter, has been prepared, and the document was continuously printed 10,000 times, and the first print and the 5,000th print were used for the evaluations. Evaluation items are as shown below.

<Uneven Density>

The halftone image was visually evaluated and density change was measured. To evaluate the density change, reflection density was measured by a micro-densitometer made by Array Corporation, and the evaluation was carried out based on the criteria below. Specifically, the reflection density of the halftone image was measured at 10 μm intervals perpendicular to the direction of feeding paper. The length of 3 cm was measured as one piece, and three pieces each of which was shifted by 1 cm in the direction of feeding paper were used for evaluation. The maximum deviation from each average value was regarded as an amount of uneven density. When an image is regarded to be acceptable by a visual inspection and the amount of uneven density is less than 0.5, the image is considered to have passed the examination.

A . . . Uniform when visually inspected, and the amount of uneven density is 0.2 or less.

B . . . Slightly uneven when visually inspected, but not a problem, and the amount of uneven density is 0.2 or less C . . . Slightly uneven when visually inspected, but not a problem, and the amount of uneven density is more than 0.2 and less than 0.5

D . . . Uneven when visually inspected, and the amount of uneven density is 0.5 or more <Fogging>

The number of image stains (fogging) on the white background of the image is visually inspected, and if the number of stains is less than 10, it is regarded to have passed the examination.

A: 0 to 3

B: 4 or more and less than 10

D: 10 or more

<Density>

The reflection density of the solid black portion was measured by a Macbeth RD-918, and a density of 1.0 or more was regarded to have passed the examination.

A: 1.5 or more (excellent)

B: 1.0 or more and less than 1.5 (practically no problem)

D: less than 1.0 (problematic)

<Resolution>: Evaluated according to a fine-line-image

A: 9 lines or more per millimeter (excellent)

B: 6 lines or more and 8 lines or less per millimeter (practically no problem)

D: 5 lines or less per millimeter (problematic)

Results are shown in Table 3.

TABLE 3

| | Uneven density | | Fogging | | Density | | Resolution | |
|---|---|---|---|---|---|---|---|---|
| | Start | 5000th | Start | 5000th | Start | 5000th | Start | 5000th |
| Embodiment 1 | A | B | A | A | B | B | A | A |
| Embodiment 2 | A | A | A | A | A | A | A | A |
| Embodiment 3 | A | A | A | A | A | A | A | A |
| Embodiment 4 | B | B | A | A | A | A | A | A |
| Embodiment 5 | B | C | A | B | A | B | A | A |
| Embodiment 6 | B | B | A | A | B | B | A | A |
| Embodiment 7 | B | C | A | B | B | B | A | B |
| Embodiment 8 | A | A | A | A | A | A | A | A |
| Embodiment 9 | A | B | A | A | A | A | A | A |
| Embodiment 10 | B | B | B | B | A | B | B | B |
| Embodiment 11 | B | C | B | B | B | B | B | B |
| Embodiment 12 | B | B | A | A | B | B | B | B |
| Embodiment 13 | B | B | A | A | B | B | A | A |
| Embodiment 14 | A | A | A | A | A | A | A | A |
| Embodiment 15 | A | A | A | A | A | A | A | A |
| Embodiment 16 | B | B | A | A | A | B | A | B |
| Embodiment 17 | B | B | A | B | B | B | A | B |
| Embodiment 18 | A | B | A | A | A | B | A | A |
| Embodiment 19 | B | B | A | B | A | B | A | B |
| Embodiment 20 | A | A | A | A | A | A | A | A |
| Embodiment 21 | B | B | A | A | A | A | A | A |
| Embodiment 22 | B | B | A | A | A | A | A | A |
| Comparative example 1 | C | D | D | D | B | D | D | D |
| Comparative example 2 | D | D | D | D | D | D | D | D |
| Comparative example 3 | B | D | A | B | B | B | A | D |
| Comparative example 4 | D | D | D | D | D | D | D | D |

As results in Table 3 clearly show, it was verified that according to the liquid development apparatus of the present invention, the viscosity of a highly viscous liquid developer is reduced in the supply head, and it is possible to steadily form toner images without inducing troubles, such as uneven density or fog, which result in deterioration of the image quality.

Furthermore, it was verified that the density did not change in the area of maximum density after continuously making 5000 prints, and the high level of resolution has also been maintained.

In a liquid development apparatus according to an embodiment of the present invention, a means consisting of a small device for applying a shear force to a liquid developer is positioned in the developer discharge outlet, which makes it possible to reduce the viscosity of the liquid developer as it passes through the outlet and immediately before the developer is supplied onto the development roller.

That is, according to an embodiment of the present invention, it is possible to steadily supply low-viscosity liquid developer onto the development roller, thereby making it possible to steadily form a thin layer of high-density liquid developer on the development roller. As a result, it is possible to provide a development apparatus which is capable of forming excellent toner image free of flaws on the image that results from uneven toner density or toner fog.

That is, the embodiment makes it possible to provide a liquid development apparatus which forms a uniformly thin layer of liquid developer on the development roller thereby forming a toner image that does not have uneven density or toner fog on the white background.

Furthermore, according to the embodiment, it possible to provide an inexpensive and compact liquid development apparatus which can form a thin layer of highly viscous liquid developer without increasing the number of components or using a large drive motor. That is, it is possible to provide an inexpensive and compact wet-process image forming apparatus by increasing the flexibility in the arrangement of the liquid development apparatus.

Furthermore, according to a liquid development apparatus of an embodiment of the present invention, it is possible to form a uniformly thin layer of high-density liquid developer on the development roller without increasing the number of components or requiring a large motor with a strong drive force, thereby making it possible to provide an inexpensive and compact liquid development apparatus. As a result, it is possible to provide an inexpensive and compact image forming apparatus which increases the flexibility in the arrangement.

Moreover, according to an embodiment of the present invention, it is possible to provide an inexpensive and compact wet-process image forming apparatus which can form high-resolution toner images, which makes it possible to create excellent printed materials on demand by the printing industry and also in environments such as offices and studios where space is limited.

What is claimed is:

1. A liquid development apparatus, comprising:

an image carrier on which an electrostatic latent image is formed;

a development roller which is arranged in an opposing position to the image carrier and develops the electrostatic latent image with a thin layer of liquid developer, provided on a surface of the development roller, containing toner and carrier liquid;

a storage tank which stores the liquid developer;

a liquid developer supply head which includes a discharge outlet which is elongated in a direction of an axis of the development roller and throughwhich the liquid developer is discharged from the storage tank onto the surface of the development roller, wherein the discharged developer forms the thin layer of the liquid developer to be used to develop the electrostatic latent image on the image carrier; and a viscosity reducing member which is provided in a vicinity of the discharge outlet to reduce viscosity of the liquid developer discharged onto the surface of the development roller, wherein the liquid developer whose viscosity has been reduced by the viscosity reducing member is discharged through the discharge outlet.

2. The liquid development apparatus of claim 1, wherein the viscosity reducing member includes a member which applies a mechanical shear force to the liquid developer.

3. The liquid development apparatus of claim 2, wherein the member which applies the mechanical shear force to the liquid developer includes a spherical member.

4. The liquid development apparatus of claim 2, wherein the member which applies the mechanical shear force to the liquid developer includes a wirelike member.

5. The liquid development apparatus of claim 2, wherein the member which applies the mechanical shear force to the liquid developer includes a rotating member.

6. The liquid development apparatus of claim 1, wherein the liquid developer supply head includes a heat source for heating the liquid developer.

7. The liquid development apparatus of claim 1, wherein the liquid developer supply head includes an ultrasonic transducer for applying ultrasonic vibration to the liquid developer.

8. The liquid development apparatus of claim 1, wherein an average viscosity of the liquid developer stored in the storage tank is no less than 5 Pas and no more than 40 Pas when measured for 60 seconds at a shear rate of 0.1/s at 25° C.

9. The liquid development apparatus of claim 1, wherein an average viscosity of the liquid developer stored in the storage tank is no less than 1 Pas and no more than 100 Pas when measured for 60 seconds at a shear rate of 0.1/s at 25° C., wherein a distance of closest approach L1 which is a distance between the development roller and a downstream side portion of the discharge outlet in a direction of rolling of the development roller satisfies the following relationship:

$0.5 \leqq L1 \cdot V\ H1/Q \leqq 1.0$ wherein: Q is a volume of the liquid developer supplied to the liquid developer supply head per second; H1 is a length of the discharge outlet in an axis direction of the development roller; V is a circumferential velocity of the rolling development roller.

10. The liquid development apparatus of claim 9, wherein L1 satisfies the following relationship: $0.8 \leqq L1 \cdot V \cdot H1/Q \leqq 0.98$.

11. A liquid development method, comprising:

reducing a viscosity of liquid developer, by using a viscosity reducing member, in a liquid developer supply head which includes a discharge outlet which is elongated in a direction of an axis of a development roller;

forming a thin layer of the liquid developer, on the development roller, by discharging the liquid developer through the discharge outlet, whose viscosity has been reduced by the reducing a viscosity of liquid developer process; and developing an electrostatic latent image formed on a image carrier with the thin layer of the liquid developer formed in the forming a thin layer of the liquid developer process; wherein the viscosity reducing member is provided in a vicinity of the discharge outlet.

12. An image forming apparatus, comprising;

a storage tank which stores liquid developer containing toner and carrier liquid;

a liquid developer supply head which includes a discharge outlet for discharging the liquid developer therethrough from the storage tank;

a development roller which carries a thin layer of the liquid developer discharged through the discharge outlet;

an image carrier on which an electrostatic latent image is formed; and a viscosity reducing member which is provided in a vicinity of the discharge outlet of the liquid developer supply head to reduce viscosity of the liquid developer, wherein the liquid developer whose viscosity has been reduced is discharged through the discharge outlet to make the thin layer of the liquid developer;

wherein the electrostatic latent image is developed by transferring the thin layer of the liquid developer to the electrostatic latent image from the development roller.

13. The image forming apparatus of claim 12, comprising:

a rolling member in the liquid developer supply head, the rolling member for applying a mechanical shear force to the liquid developer; and a detecting section which detects a driving torque of the rolling member.

* * * * *

UNITED STATES PATENT AND TRADEMARK OFFICE

CERTIFICATE OF CORRECTION

PATENT NO. : 7,676,180 B2
APPLICATION NO. : 11/444824
DATED : March 9, 2010
INVENTOR(S) : Makiko Watanabe It is certified that error appears in the above-identified patent and that said Letters Patent is hereby corrected as shown below:

In the Claims

In column 17, claim 9, line 42, after "at 25°" replace "C.," with --C,--.

In column 17, claim 9, line 47, replace "$0.5 \leqq L1 \cdot V\ H1/Q \leqq 1.0$" with --$0.5 \leq L1 \cdot V \cdot H1/Q \leq 1.0$--.

In column 18, claim 10, lines 5-6, replace "$0.8 \leqq L1 \cdot V \cdot H1/Q \leqq 0.98$." with --$0.8 \leq L1 \cdot V \cdot H1/Q \leq 0.98$.--.

Signed and Sealed this

Twenty-fifth Day of May, 2010

David J. Kappos

David J. Kappos
*Director of the United States Patent and Trademark Office*